US010626590B2

(12) United States Patent
Pytlewski

(10) Patent No.: US 10,626,590 B2
(45) Date of Patent: Apr. 21, 2020

(54) SYNTHETIC FLUID IMPERVIOUS GASKET

(71) Applicant: Walter Pytlewski, Post Falls, ID (US)

(72) Inventor: Walter Pytlewski, Post Falls, ID (US)

( * ) Notice: Subject to any disclaimer, the term of this patent is extended or adjusted under 35 U.S.C. 154(b) by 108 days.

(21) Appl. No.: 15/953,911

(22) Filed: Apr. 16, 2018

(65) Prior Publication Data

US 2019/0316338 A1 Oct. 17, 2019

(51) Int. Cl.
*E03D 11/17* (2006.01)

(52) U.S. Cl.
CPC ..... *E03D 11/17* (2013.01)

(58) Field of Classification Search
CPC ..... E03D 11/17
USPC ..... 4/252.5, 252.6
See application file for complete search history.

(56) References Cited

U.S. PATENT DOCUMENTS

| | | | | |
|---|---|---|---|---|
| 4,482,161 | A | 11/1984 | Izzi | |
| 5,114,980 | A | 5/1992 | Lii et al. | |
| 7,358,282 | B2 | 4/2008 | Krueger et al. | |
| 8,263,673 | B2 | 9/2012 | Hyoudou et al. | |
| 8,671,470 | B2 | 3/2014 | Miller et al. | |
| 8,955,172 | B2 | 2/2015 | Culwell | |
| 9,556,603 | B2 | 1/2017 | Guthrie | |
| 2001/0023505 | A1* | 9/2001 | Atkins | E03D 11/16 4/252.6 |
| 2003/0009820 | A1 | 1/2003 | Telles | |
| 2006/0030632 | A1* | 2/2006 | Krueger | A61L 15/225 521/50 |
| 2011/0185487 | A1 | 8/2011 | Miller et al. | |
| 2012/0225773 | A1 | 9/2012 | Krueger et al. | |
| 2015/0292190 | A1* | 10/2015 | Coronado | E03D 11/16 4/252.6 |

FOREIGN PATENT DOCUMENTS

| | | | |
|---|---|---|---|
| CA | 2423710 | A1 | 10/2003 |
| JP | 11104661 | A | 4/1999 |
| JP | 2001020618 | A | 1/2001 |
| JP | 2001139929 | A | 5/2001 |

* cited by examiner

*Primary Examiner* — Lauren A Crane
(74) *Attorney, Agent, or Firm* — Randall Danskin P.S.

(57) ABSTRACT

A synthetic, fluid impervious gasket for releasably, and fluid sealably coupling a fluid delivering assembly, and a fluid receiving assembly, together, is described, and which includes an annular shaped main body which defines, at least in part, a medial fluid passageway, and a flexible, funnel portion is fabricated from a synthetic, polymeric, closed-cell, resilient, and fluid impervious material, and which forms a part of the medial fluid passageway, and which further can be selectively moved between a first and second operational position so as to allow the annular shaped main body to simultaneously fluid sealably engage with a fluid delivering assembly, and a fluid receiving assembly, respectively.

15 Claims, 6 Drawing Sheets

SYNTHETIC FLUID IMPERVIOUS GASKET

TECHNICAL FIELD

The present invention relates generally to the field of gaskets which are positioned between a toilet base, and a toilet flange mounted on an adjacent supporting surface.

BACKGROUND OF THE INVENTION

A toilet gasket is positioned between the outlet base of a toilet, and the outwardly facing surface of a toilet flange, and which is further coupled in fluid delivering relation relative to a drain conduit or pipe, and which further leads to a sewer. The object of the gasket is to provide a liquid, and gas seal between the toilet, and the adjacent drain pipe.

The prior art gaskets disclosed, heretofore, have typically been fabricated from a pliable wax. When the toilet is removed for repair for replacement, such as during a remodel of a bathroom, the old wax seal must also be removed before a new gasket can be installed. Thus, the prior art, wax gaskets are not repositionable, nor are they reusable. It has also long been known that the prior art wax gaskets have some ability to retain at least a small amount of liquid, and some human waste, which the seal is exposed to.

In view of this situation, it has also been known that removing a wax gasket typically subjects a plumber or other workmen to contact with the unsanitary contents of the inside of the near-by drain pipe. In addition to all the problems noted, above, it has also been known that in cold, or hot environments, these same wax seals, on occasion, may become less pliable at very low temperatures, or can even melt at very high temperatures, thereby impairing or perhaps even destroying, the functionality of the wax gasket.

A number of U.S. patents have been granted on toilet gaskets. U.S. Pat. No. 6,694,537 issued to Telles discloses a polyethylene foam gasket having a predetermined resilience, and which further retains the ability to recover substantially its original shape, and thickness after compression loading. Further, U.S. Pat. No. 6,691,331 issued to Telles discloses an elastomeric gasket located between the toilet bowl, and an adjacent floor. Still further, U.S. Pat. No. 3,821,820 issued to Thompson discloses a toilet gasket having a ring of wax-like material. Moreover, U.S. Pat. No. 4,482,161 issued to Izzi, discloses a toilet gasket designed to replace the conventionally used wax sealing rings, and which additionally has a main body fabricated of a synthetic, resilient material, such as polyvinyl chloride (PVC). Yet further, U.S. Patent Publication 2006/0225195 to Scholer discloses an anti-microbial material for use in toilet wax gaskets; and U.S. Pat. No. 5,114,980 issued to Lii et al. discloses a polyurethane integral skin foam. In addition to the foregoing, U.S. Pat. No. 8,671,470 issued to Miller et al. discloses an open-cell foam gasket which incorporates a hydrophobic layer covering the outer surface of the gasket. This covering is typically composed of polychloroprene. However vinyl, and PVC, may also may be utilized.

The present invention provides several advantages over the prior art references, and practices utilized, heretofore. More specifically, the present invention is more durable, and is able to maintain an acceptable fluid seal over prolonged periods of time. Those skilled in the art have found that the products fabricated from the teachings of the aforementioned patents have not provided a solution to correct the many problems discussed, above. For example, as cracks or tears form in the material which is used to fabricate the prior art toilet gaskets, the integrity of the fluid seal is compromised. This is of particular concern in the case of toilet gaskets, inasmuch as the fluids coming from the toilet are undesirable from a health perspective, in that they potentially carry diseases, and from an aesthetic perspective, because they are unpleasant to smell.

Previous solutions that use an outer, fluid impervious coating on the toilet gasket have been found to be deficient to solve the aforementioned problems. For example, an outer fluid impervious coating may be compromised by the natural use of the toilet, such as by sitting on the toilet. On occasion, the action of sitting on, and then using a toilet, especially by individuals having a large body mass, may have the effect of slightly moving the toilet relative to the adjacent gasket. This small amount of movement is present in toilet installations because the toilet is typically fabricated from porcelain or another breakable material, and an overtightening of the toilet to the underlying floor or other supporting surface during installation, may crack the porcelain forming the toilet. Since overtightening is a concern during installation, it will be recognized that there is nearly always a potential for some small amount of toilet movement. Further, this same small amount of toilet movement has the effect of creating friction between the toilet, the toilet flange, and the toilet gasket positioned therebetween. This friction may, on occasion, compromise (frictionally erode, puncture or tear) an outer fluid impervious coating which has been provided, thereby creating a less than optimally protected region in the outer fluid impervious coating, and the underlying gasket.

Still further, the securing or fastening means for the toilet gasket, such as a bolt and nut, that also releasably secures the toilet flange to the toilet base, will also present locations at which the desired fluid seal may potentially be compromised. For example, and in the case of a prior art toilet gasket which includes an outer fluid impervious coating, either the outer fluid impervious coating will not be effectively delivered into the access holes formed in the toilet gasket and which receive the bolts, or other fasteners, or the installation or removal of the bolts will compromise any fluid impervious coating delivered to this same region.

What is needed is a gasket which avoids the shortcomings of the prior art gaskets, while simultaneously maintaining an acceptable fluid sealing relationship between, for example, a toilet outlet, and an adjacent drain pipe.

SUMMARY OF THE INVENTION

A first aspect of the present invention relates to a synthetic, fluid impervious gasket for releasably, and fluid sealably, coupling a fluid delivering assembly and a fluid receiving assembly, and which includes an annular-shaped main body fabricated from a synthetic, polymeric, closed-cell, resilient, and fluid impervious material, and which further defines, at least in part, a medial fluid passageway which extends therethrough; and a flexible funnel fabricated from the synthetic, polymeric, closed-cell, resilient, fluid impervious material, and wherein the flexible funnel has a frustum shape, and wherein the flexible funnel matingly couples with the annular-shaped main body, and wherein the flexible funnel defines, at least in part, the medial fluid passageway which extends therethrough, and wherein the flexible funnel can be selectively moved between a first and a second operational position so as allow the annular-shaped main body to releasably, and fluid sealably, engage with a fluid delivering assembly and a fluid receiving assembly.

A further aspect of the present invention includes a synthetic, fluid impervious gasket for releasably, and fluid sealably, coupling together a fluid delivery assembly, and a fluid receiving assembly, and which further includes an annular-shaped main body fabricated from a synthetic, polymeric, closed-cell, resilient, and fluid impervious material, and which further defines, at least in part, a medial fluid passageway extending therethrough, and wherein the medial fluid passageway has a longitudinal line of reference, and wherein the annular-shaped main body further has a first, substantially planar surface which releasably, and fluid sealably, mates with a fluid receiving assembly, and a second, concavely shaped surface which releasably, and fluid sealably, mates with a fluid delivering assembly; and a flexible funnel portion is fabricated from the synthetic, polymeric, closed-cell, resilient, and fluid impervious material, and wherein the flexible funnel portion is frustum shaped, and wherein the flexible funnel portion has a first end that is coupled to the annular-shaped main body at a location which is near the first, substantially planar surface, and wherein the flexible funnel portion is oriented in substantially coaxial alignment with the longitudinal line of reference, and wherein the flexible funnel portion further defines, at least in part, a portion of the medial fluid passageway, and wherein the flexible funnel portion is positioned in a fluid delivering relationship relative to the fluid receiving assembly; and wherein the flexible funnel portion can further be selectively moved between a first, and a second operational position, so as allow the annular-shaped main body to releasably, and fluid sealably, cooperate with the fluid receiving assembly, and wherein the flexible funnel portion, when located in the first operational position is, at least in part, telescopingly positioned within the annular-shaped main body, and wherein the flexible funnel portion, when located in the second operational position, depends outwardly relative to the first, substantially planar surface of the annular-shaped main body.

These and other aspects of the present invention will be discussed in greater detail hereinafter.

BRIEF DESCRIPTION OF THE DRAWINGS

Preferred embodiments of the present invention are described, below, with reference to the following accompanying drawings.

FIG. 8 is a transverse, vertical, sectional view of a prior art gasket which is typically employed for the installation of toilets, and the like.

FIG. 9 is a transverse, vertical, sectional view of another form of a prior art gasket which is typically employed for the installation of toilets and the like.

DETAILED DESCRIPTION OF THE PREFERRED EMBODIMENTS

This disclosure of the invention is submitted in furtherance of the constitutional purposes of the U.S. Patent Laws "to promote the progress of science and useful arts (Article I, Section 8).

Figure 1:
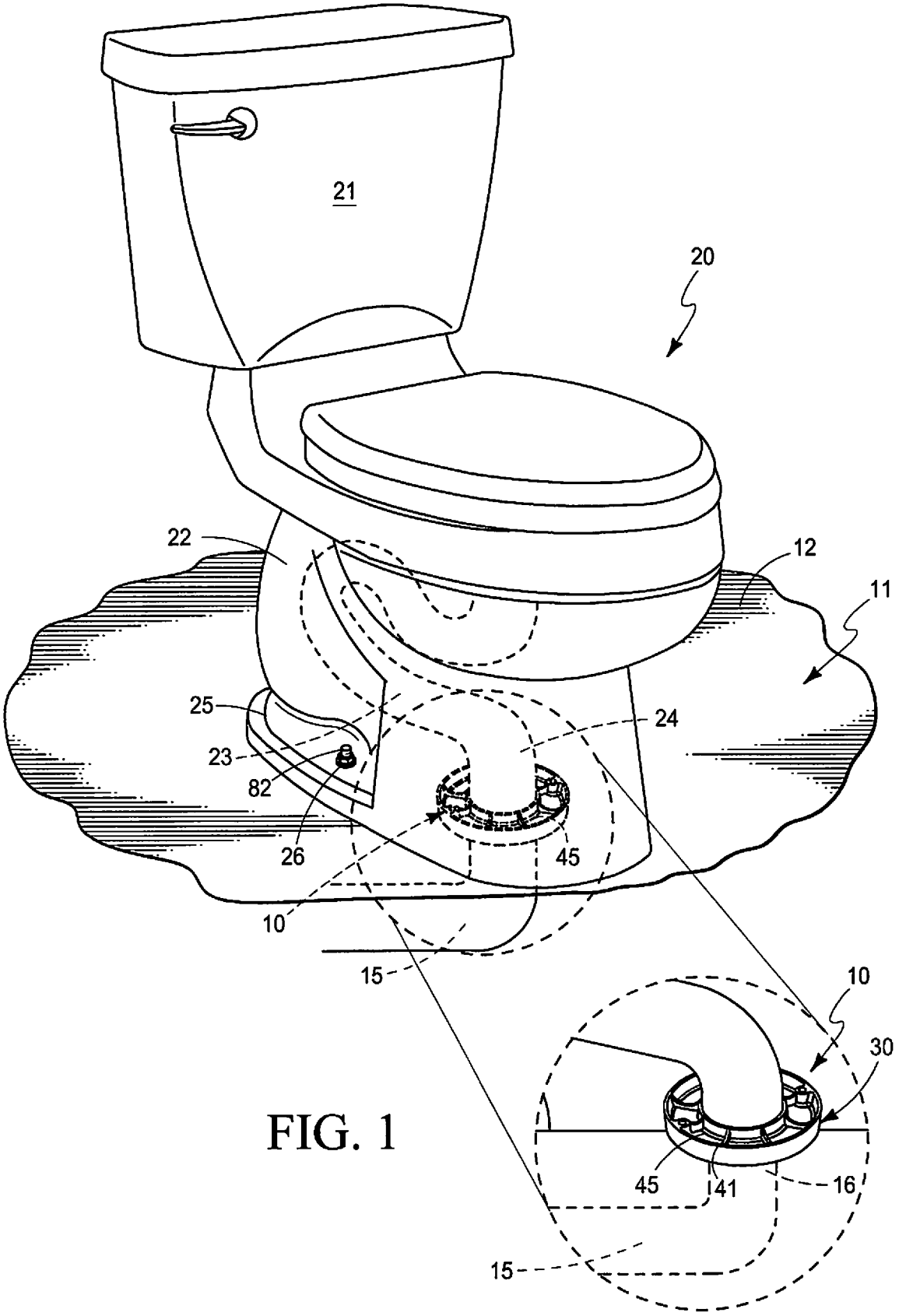
FIG. 1 is perspective, environmental view of the present invention shown in a typical, installed arrangement.
Figure 1A:
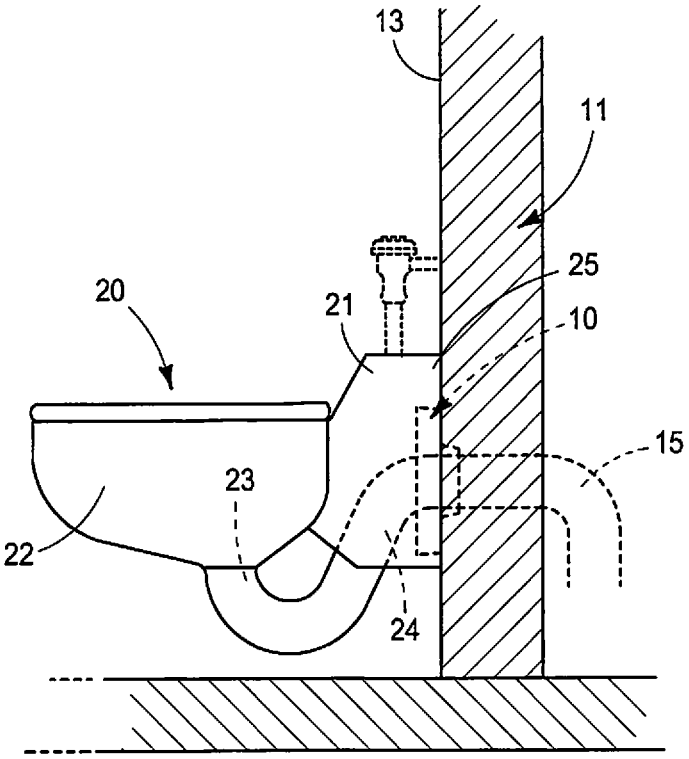
FIG. 1A is second, side elevation, environmental view of the present invention shown in a typical, installed arrangement.
Figure 2:
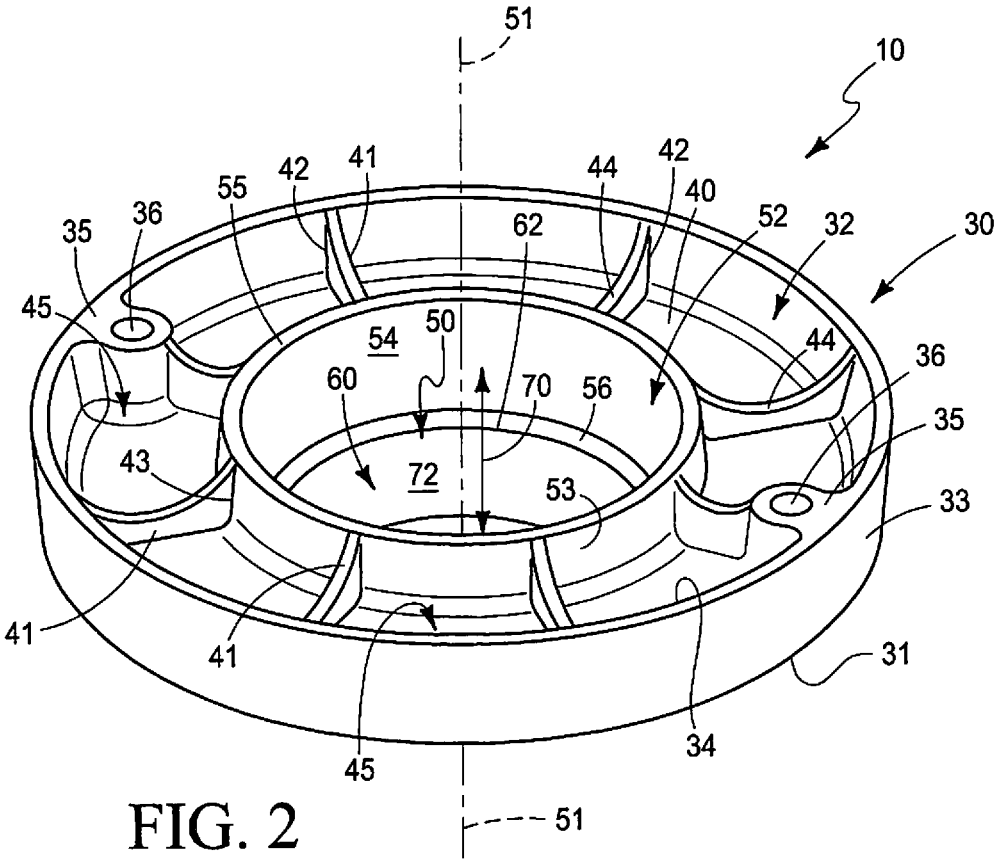
FIG. 2 is perspective, side elevation view of the present invention shown in a possible, operable configuration.
Figure 7A:
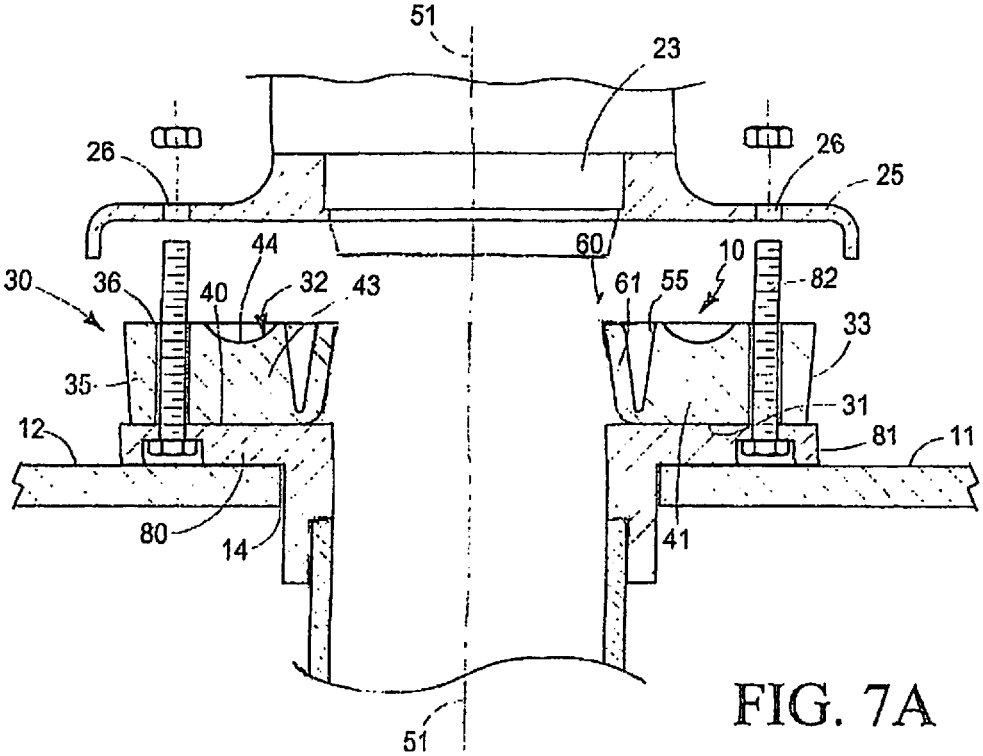
FIG. 7A is a partially exploded, transverse, vertical sectional view of the present invention shown in a typical installed arrangement.
Figure 7B:
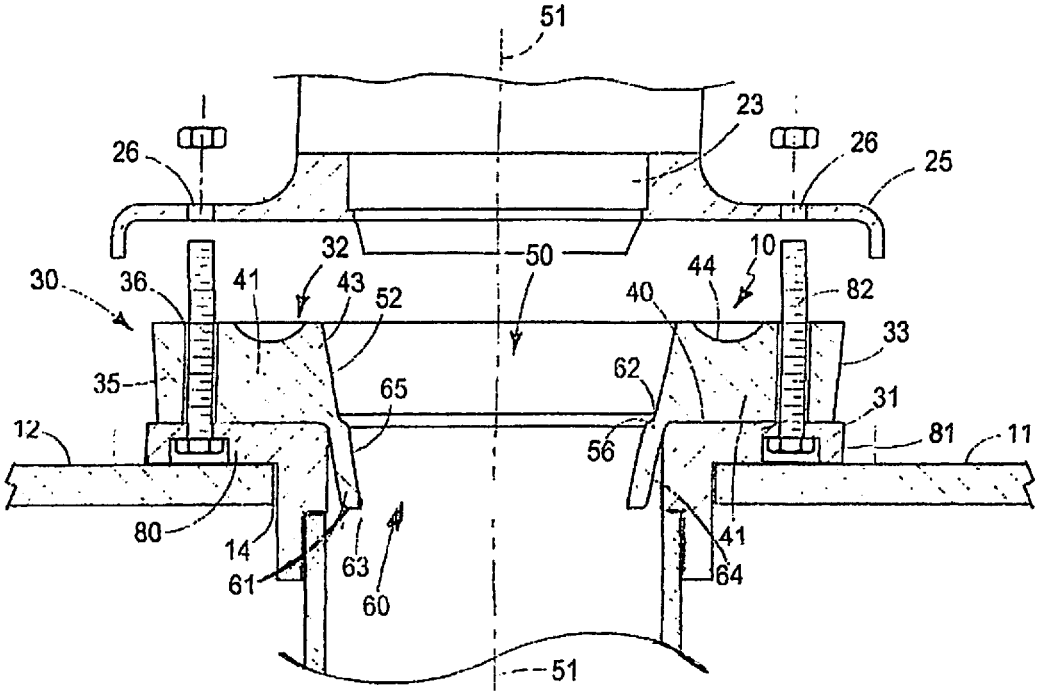
FIG. 7B is a partially exploded, transverse, vertical sectional view of the present invention shown in another possible installed arrangement.

Referring now to the drawings, the present invention relates to a synthetic, fluid impervious gasket, and which is generally indicated by the numeral 10, in FIG. 1, and following. As seen in the drawings, the new gasket 10 is typically located adjacent to a supporting surface, and which is indicated by the numeral 11. In this regard, the supporting surface 11 can be a generally, horizontally oriented surface 12, such as an underlying floor (FIG. 1), or a vertically disposed surface 13, such a wall for a room (FIG. 2). As should be understood from the attached drawings, an aperture of a given shape and size, and which further is generally indicated by the numeral 14, is formed in the supporting surface 11, and is sized so as to allow a fluid receiving assembly 15 to be positioned therein, or accessed through the aperture 14 (FIGS. 7A and 7B). As should be clear from a study of the attached drawings, the fluid receiving assembly 15 is depicted, in one possible form of the invention, as a waste pipe or other conduit. The waste pipe or other conduit 15 has a given inside and outside diametral dimension, and which further has a fluid receiving end 16, and which further is oriented in downstream, fluid receiving relation relative to a source of fluid or other liquid waste stream (not shown), and which originates from a fluid delivering assembly as described in the next paragraph. As will be discussed, hereinafter, the waste pipe or other conduit 15 may have different inside and outside diametral dimensions, and the present invention 10 is operable to sealably cooperate with these differently dimensioned fluid or other waste conduits in the manner which will be discussed in greater detail, hereinafter.

The synthetic, fluid impervious gasket 10 is operable to releasably, and fluid sealably couple a fluid delivering assembly, here illustrated as a toilet, or similar product 20, with the fluid receiving assembly 15, as described, above. The fluid delivering assembly, or toilet 20 includes, as seen in FIG. 1, and following, a tank or fluid storage portion 21, and which is operable to release a source of fluid, such as water,(not shown), and which is used for flushing, emptying or otherwise evacuating a bowl region of the stool portion 22 of the toilet 20. The selective release of water from the tank portion 21 is effective to evacuate, flush or empty the bowl region of the stool portion, and thereby take or remove any solid or other liquid waste, and urge or otherwise carry or propel the solid or liquid waste, not shown, in the direction of the toilet outlet 23, and in a manner which is well known in the art. In this regard, the toilet outlet 23 has a distal, downstream end 24, and which is oriented in fluid, discharging relation relative to the fluid receiving end 16 of the waste pipe or conduit 15. The stool portion 22 further includes a base flange 25 which rests, or is otherwise securely positioned on, or juxtaposed relative to, the supporting surface 11. As seen in the several drawings which are attached to this application, fastener apertures 26 are formed in predetermined locations in the base flange 25, and are further operable to receive, and then cooperate with individual fasteners which pass therethrough, and which will be described in greater detail, hereinafter.

The synthetic, fluid impervious gasket 10 of the present invention is defined, at least in part, by an annular shaped main body 30, and which is fabricated from a synthetic, polymeric, closed-cell, resilient, and uniformly fluid impervious material which is fabricated from either an ethylene vinyl acetate, an olefin block copolymer, or a similar and preferably moldable material. The synthetic and fluid impervious material typically uniformly repels the previously mentioned source of fluid moving through the toilet outlet 23 despite any tearing or puncturing that the main body 30 might experience, and which could conceivably occur upon the installation, or during the subsequent use of the toilet 20, as earlier described. This inventive feature ensures that the fluid sealing integrity of the gasket 10 is maximized throughout its installed, and expected lifetime. The annular shaped main body 30 further has a thickness dimension which is defined between a first, substantially planar surface 31, and a second, concavely shaped surface 32. The second, concavely shaped surface 32 is formed, or otherwise defined, at least in part, by an outwardly facing, circumscribing, and flexible exterior sidewall portion, and which is generally indicated by the numeral 33. The circumscribing and flexible, exterior sidewall portion 33 is defined, at least in part by an interior facing surface label 34. As best seen in FIG. 2, individual fastener receiving members 35 are made integral with, and extend generally radially, inwardly relative to the inside facing surface 34. The respective fastener receiving members further define apertures, channels or passageways 36, and which will substantially coaxially align with the fastener apertures 26. The fastener apertures are formed in the toilet base flange 25 as discussed, above.

Figure 3:
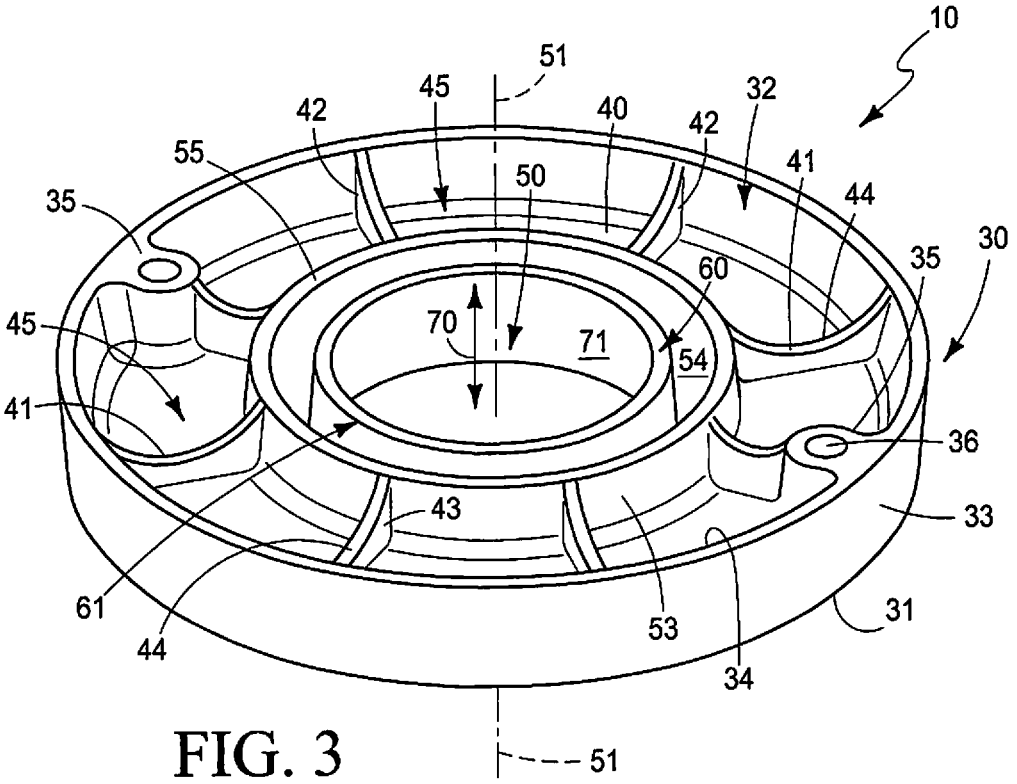
FIG. 3 is a perspective, side elevation view of the present invention shown in a second, possible, operable configuration.

The second, concavely shaped surface 32 of the annular shaped main body 30 is defined, at least in part, by a bottom, inside facing surface 40, and which is best seen in FIGS. 2 and 3, respectively. The bottom, inside facing surface further has mounted thereon, or made integral therewith, a plurality of radially oriented, spaced, and flexible support members which are generally indicated by the numeral 41, and which are further fabricated from the same, closed cell, fluid impervious material which was discussed, above. The radially oriented, spaced, and flexible support members each have a first end 42, and which is made integral with, or otherwise fastened to, the inside facing surface 34 of the circumscribing and flexible, exterior sidewall portion 33. Still further, the respective flexible support members 41 each have a second end 43. The respective, radially oriented, spaced, and flexible support members 42 typically extend normally, upwardly, relative to the bottom, inside facing surface 40. Still further, the respective radially oriented, spaced, and flexible support members each have a variable height dimension when this height dimension is measured along the length dimension of the respective support members, and which are defined between the first and second ends 42 and 43, respectively. In particular, it should be noted that the respective, radially oriented, spaced, flexible support members 41 each have a central region 44 which has a diminished height dimension, and which is further oriented approximately intermediate the first and second ends 42 and 43, respectively. This diminished dimensioned central region 44 allows the circumscribing flexible exterior sidewall 33 to flex, at least to some degree, both radially inwardly, and/or outwardly, when placed under a compression force, and which may be caused, at least in part, when the fluid delivering assembly 20 is threadably fastened to the underlying supporting surface 11 by means of fasteners as will be discussed in greater detail, hereinafter. The respective, radially oriented, spaced, and flexible support members 41, in combination with the bottom inside facing surface 40 define, at least in part, a plurality of discrete cavities 45 which permit the annular shaped main body 30 to flexibly conform, and then fluid sealably engage both the adjacent, supporting surface 11, and the toilet outlet 23 so as establish, and thereafter maintain, a highly desirable fluid seal so as to ensure the delivery of water, and the associated waste carried by the water, to the fluid receiving assembly 15, and which is here depicted as a typical waste conduit in FIGS. 1 and 2, respectively.

Referring now to the drawings the annular shaped main body 30 of the aforementioned synthetic and fluid and impervious gasket 10 has or otherwise defines a centrally disposed, medial, fluid passageway, and which is generally indicated by the numeral 50. This centrally disposed, medial, fluid passageway 50 extends therethrough the main body 30, and further is defined, at least in part, by a longitudinal line of reference which is indicated by the numeral 51. The medial, fluid passageway 50 is defined, at least in part, by a first portion 52. The first portion includes a sidewall which has a radially outwardly disposed surface 53, and an opposite, radially inwardly disposed surface 54. This sidewall or first portion 52 further has an exterior, or otherwise outwardly facing peripheral edge 55, and additionally has a distal end 56, and which couples with, or is joined to a funnel portion as will be described in greater detail in the paragraphs which follow. The sidewall or first portion 52 is generally cylindrically shaped, and the radially, outwardly disposed surface 53 is made integral, at least in part, with the second end 43 of each of the radially spaced, and flexible support members 41. The first portion or sidewall 52 further has a given inside diametral dimension 52 which is typically larger than the outside diametral dimension of the conduit 15 which forms the fluid receiving assembly as discussed, above.

Figure 4:
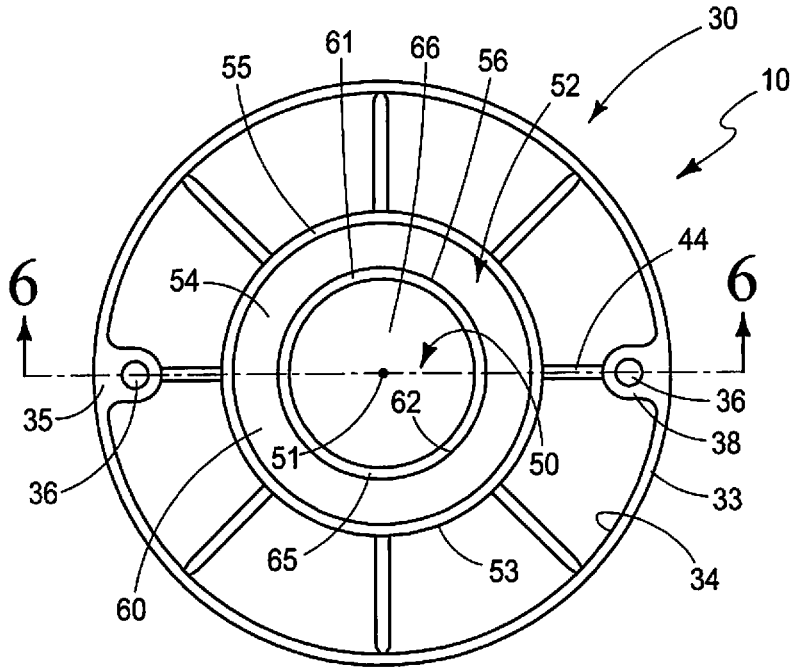
FIG. 4 is a top, plan view of present invention.
Figure 5:
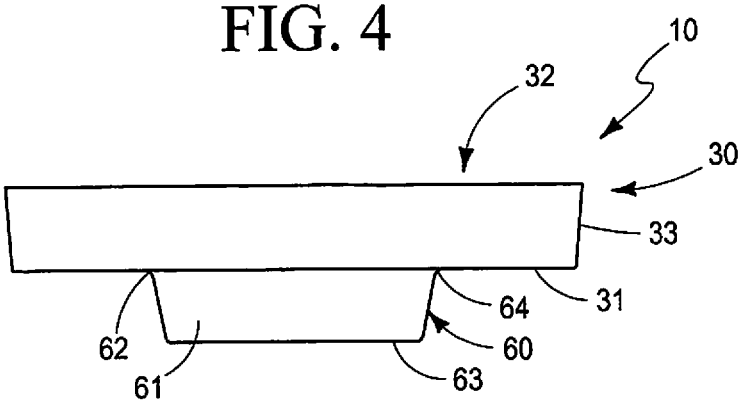
FIG. 5 is a side elevation view of the present invention.
Figure 6:
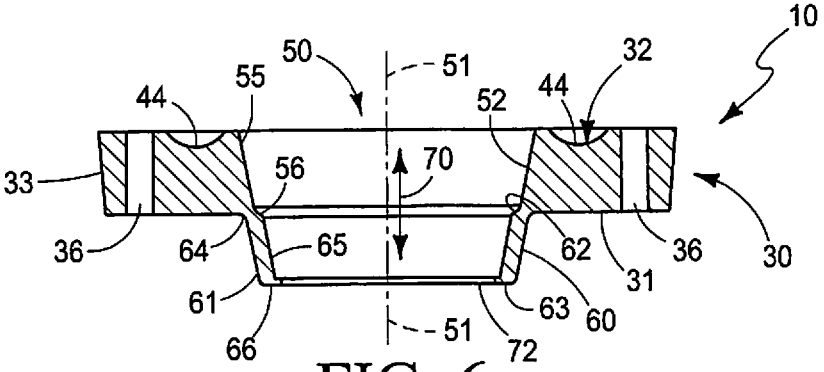
FIG. 6 is a transverse, vertical, sectional view taken from a position along line 6-6 of FIG. 4.

The synthetic, fluid impervious gasket 10, and more specifically the main body thereof 30, further includes a flexible funnel portion and which is generally indicated by the numeral 60, and which further has a main body 61 which is fabricated from the earlier mentioned, synthetic, polymeric, closed-cell, resilient, and fluid impervious material as previously described. The main body 61, as seen in the drawings, is generally frustum shaped, and further, the flexible funnel portion 60 defines, at least in part, a portion of the centrally disposed, medial, fluid passageway 50, as earlier described. The flexible funnel portion 60 further has a first end 62 which is resiliently affixed or otherwise made integral with the distal end 56 of the first portion or sidewall 52, as described, above. The first end 62 further is located closely adjacent to, or is substantially co-planar with the first, planar surface 31 as defined by the annular shaped main body 30. Still further, the flexible funnel portion 60 has a distal, second end 63. The flexible funnel portion 60 is defined, at least in part, by an outside facing surface 64, as seen in the drawings, and an opposite, inside facing surface 65, and which forms a feature, or a portion of the centrally disposed, medial, fluid passageway 50. As seen in FIGS. 3 and 4, a reduced dimensioned aperture 66 is formed in the second end 63, and allows the stream of fluid and/or other entrained waste material coming from the fluid delivery assembly or toilet 20, to pass therethrough, and into the waste pipe or conduit 15, in the manner which will be discussed, hereinafter.

The flexible funnel portion 60 is moveable along a predetermined, substantially linear path of movement, and which is generally indicated by the numeral 70. The path of movement is defined between a first operational position 71, and where the main body 61 is, at least in part, telescopingly positioned within the annular shaped main body 30, and is further substantially co-axially aligned with and generally positioned along the longitudinal line of reference 51. Still further, the flexible funnel portion 60 is moveable along the path of movement 70, to a second operational position 72, as seen in FIG. 2. As should be understood from the drawings (FIGS. 7A and 7B), and when located in the first position 71, the flexible funnel portion 60 which is defined, at least in part, by the first end 62, is coupled to or made integral with the annular shape main body 30 at a location which is near the first, substantially planar surface 3. Further, the flexible funnel portion 60, has an opposite, and distal second end 63, as earlier discussed, and which further has the reduced dimensioned aperture 66 formed therein. As should be recognized by a study of FIG. 3, when the flexible funnel portion 60 is located in the second position 72, the flexible funnel portion 60 depends outwardly relative to the first, substantially planar surface 31, of the annular shaped main body 30. As further seen in drawings, the opposite, distal, and second end 63 of the flexible funnel 60 can be oriented or otherwise disposed or positioned in a fluid delivering relationship relative to the fluid receiving assembly 16 of the waste conduit 15. In the first position 71, and where the main body 61 is telescopingly received, at least in part, within the annular shaped main body 30, this orientation permits the synthetic fluid impervious gasket 10 to sealably couple to a waste conduit 15 which has an outside diametral dimension which would not facilitate the receipt of the second, distal end 63 in a telescoping relationship as seen in the drawings (FIG. 7B).

It should be understood that the medial, fluid passageway 50 directs a source of fluid or other waste stream in a direction extending from the second, concavely shaped surface 32, of the annular shape main body 30, and in a direction towards the first substantially planar surface 31. Still further, and when the flexible funnel 60 is located in the first position 71 (FIG. 7A), the medial fluid passageway 50 directs the source of fluid or other waste stream in a direction extending from the opposite, distal, second end 63 of the flexible funnel 60, and in a direction towards the first end 62, thereof. Still further, when the flexible funnel 60 is located in the second position 72 (FIG. 7B), the medial fluid passageway 50 has the effect of directing the source of fluid or other waste stream in a direction extending from the first end 62, of the flexible funnel 60, and in a direction towards the opposite, second, or distal end 63. As should be apparent from studying FIGS. 2 and 7A for example, the medial fluid passageway 50 has a predetermined inside diametral dimension which diminishes when measured in a direction extending from the second, concavely shaped surface 32 of the annular shaped main body 30, and in a direction towards the first, substantially planar surface 31. Again, the movement of the flexible funnel portion 60 along the path of movement 70, allows the annular shaped main body 30 to releasably and fluid sealably engage with both a fluid delivering assembly 20, and a fluid receiving assembly 15, as earlier described. It should be understood that the particular synthetic, polymeric, closed-cell, resilient, and fluid impervious material which is selected is typically moldable so as to produce a resulting product that has a density which could be as low as one pound per cubic foot, and as high a density as about 50 pounds per cubic foot. Ideally, and in most instances, the resulting product will have a manufactured density in the range of about 3 to about 6 pounds per cubic foot.

As seen in the drawings, the fluid delivering assembly, or toilet 20 is mounted to the underlying supporting surface 11 by means of a toilet mounting flange 80 (FIGS. 7A and 7B,) and which further matingly cooperates, at least in part, with the conduit hole or aperture 14. As earlier discussed, the conduit hole or aperture 14 is sized so as receive or cooperate with the waste pipe or conduit 15. As will be appreciated, these toilet mounting flanges 80 are well known in the art, and have been used for many decades. Each toilet mounting flange that is commercially available has a peripheral edge 81 which rests on the underlying supporting surface 11. The peripheral edge supports, or positions a pair of fastener 82 in a predetermined spaced orientation, one relative to the other, so as to be able to be matingly received through the respective fastener apertures 36, and which are further defined by the fastener receiving members 35, of the annular shaped main body 30. Once received through the fastener apertures 36, these threaded fasteners 82 are then received through the fastener apertures 26, and which are formed in the toilet base flange 25, and thereafter are used to reliably secure the toilet 20, to the toilet flange member 80 by a complementary threaded nut, so as to securely, and sealably position the synthetic, fluid impervious gasket 10 in an appropriate, fluid sealing position, or orientation between the toilet outlet 23, and the waste conduit 15 in a manner which is well understood in the art. As should be appreciated, the movement of the funnel member 60 between the first and second operational positions, 71 and 72, prior to installation, allows the present synthetic, fluid impervious gasket 10 to be utilized on waste conduits having different outside diametral dimensions thereby increasing the utility of the present invention.

Figure 8:
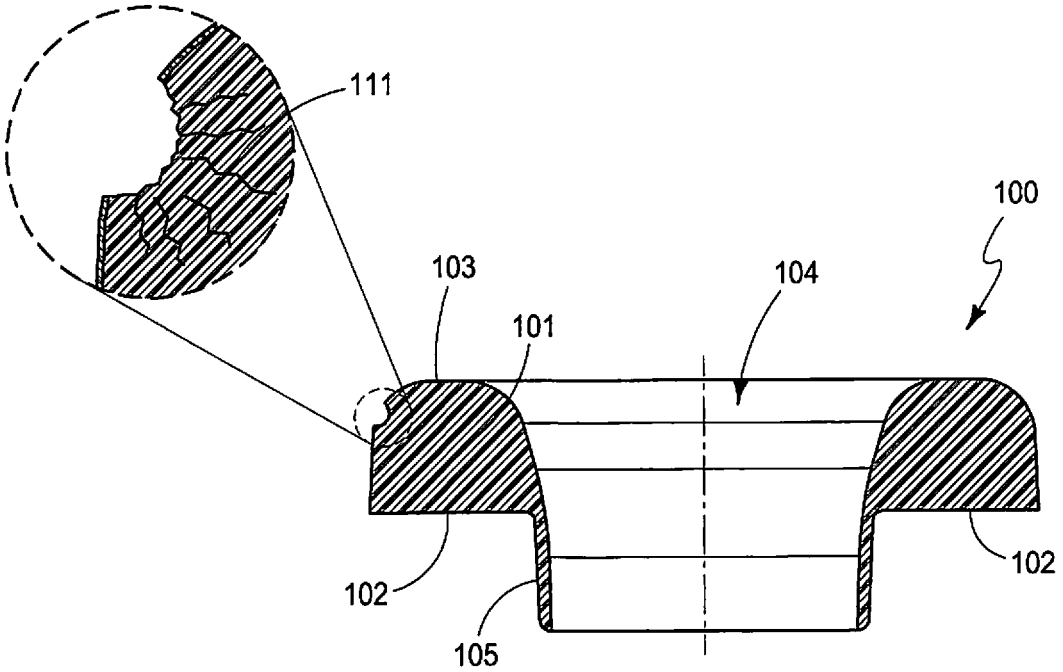
FIG. 8 (PRIOR ART)
Figure 9:
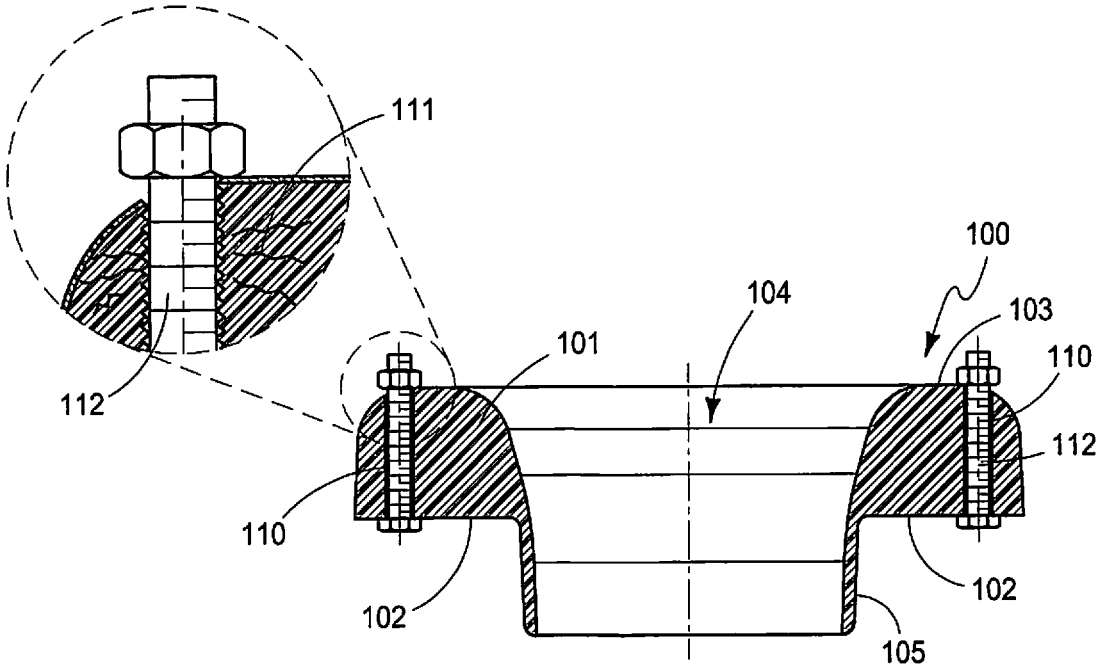
FIG. 9 (PRIOR ART)

Referring now to FIGS. 8 and 9, prior art gaskets for sealing toilets 20 are illustrated. As discussed in the Background of the Invention portion of the present patent application, the prior art forms of these gaskets are each indicated by the numeral 100 in these views. In this regard, the respective forms of the prior art gaskets each have a main body 101, and which has a first, planar surface 102, and a second, opposite, convexly shaped surface 103. Still further, the main body 101 defines a medial fluid passageway or channel 104 extending therethrough. The prior art forms of these same gaskets 100 each typically include a flexible funnel portion 105, and which operates in a manner similar to that described with respect to the new invention 10. As seen in FIG. 9, and in one possible form of the prior art gasket 100, fastener apertures 110 are formed in the main body 101, and are sized to receive fasteners which extend therethrough, and which further can matingly and securely cooperate with the earlier mentioned toilet base flange 25 (not shown in this view). Further as seen in FIGS. 8 and 9 deteriorated regions 111 of the main body 101 is illustrated, and which is provided so as to explain how the prior art gaskets sometimes failed to effectively seal a toilet 20 by either by experiencing a tearing or perforating of the main body 101, or by a cracking of a previously applied water impervious coating which was previously applied to the main body 101 during the manufacturing process.

OPERATION

The operation of the described embodiment of the present invention is believed to be readily apparent, and is briefly summarized at this point.

In its broadest aspect the present invention relates to a synthetic fluid impervious gasket 10 for releasably, and fluid sealably coupling a fluid delivering assembly 20, and a fluid receiving assembly 15, together. In this regard, the fluid impervious gasket 10 includes an annular-shaped main body 30 which is fabricated from a synthetic, polymeric, closed-cell, resilient, and fluid impervious material, and further defines, at least in part, a medial fluid passageway 50, and which further extends therethrough. In addition to the foregoing, the fluid impervious gasket 10 includes a flexible funnel portion 60 which is fabricated from the synthetic, polymeric, closed-cell, resilient and fluid impervious material, and wherein the flexible funnel portion 60 has a general, frustum shape. The flexible funnel portion 60 is made integral with the annular shaped main body 30, and the flexible funnel portion 60 defines, at least in part, a portion of the medial fluid passageway 50 which extends therethrough. The flexible funnel portion 60 can be selectively moved between a first operational position 71, and a second operational position 72, so as to allow or facilitate the annular shaped main body 30 to releasably, and fluid sealably engage a fluid delivering assembly 20, and an adjacent, fluid receiving assembly 15.

More specifically, the present invention relates to a synthetic, fluid impervious gasket 10 for releasably, and fluid sealably coupling together a fluid delivery assembly 20, and a fluid receiving assembly 15, and which includes an annular shaped main body 30 which is fabricated from a synthetic, polymeric, closed-cell, resilient, and fluid impervious material, and which further defines, at least in part, a medial fluid passageway 50 which extends therethrough. The medial fluid passageway 50 is defined, at least in part, by a longitudinal line of reference 51. The annular shaped main body 30 has a first, substantially planar surface 31 which releasably, and fluid sealably mates with a fluid receiving assembly 15, and a second, concavely shaped surface 32, and which further releasably, and fluid sealably mates with the fluid delivering assembly 20. The gasket 10 of the present invention includes a flexible funnel portion 60 which is fabricated from the synthetic, polymeric, closed-cell, resilient, and fluid impervious material. As earlier discussed, the flexible funnel portion 60 is generally frustum shaped, and further has a first end 61 that is made integral with the annular shaped main body 30 at a location which is near the first, substantially planar surface 31, and is further oriented in substantially coaxial alignment relative to the longitudinal line of reference 51. The flexible funnel portion 60 defines, at least in part, a portion of the medial fluid passageway 50, and wherein the flexible funnel portion 60 is positioned in a fluid delivering relationship relative to the fluid receiving assembly 15. The flexible funnel portion 60 can be selectively moved, before installation, between a first and second operational position 71 and 72, so as to allow the annular shaped main body 30 to effectively fluid sealably cooperate with the fluid receiving assembly 15. The flexible funnel portion 60, when located in the first operational position 71 is, at least in part, telescopingly positioned within the annular shaped main body 30. Further, and when located in the second operational position 72, the flexible funnel portion 60 depends, outwardly, relative to the first substantially planar surface 31 of the annular shaped main body 30.

Therefore, it will be seen that the present fluid gasket 10 provides a convenient means for avoiding the shortcomings attendant with the prior art gaskets 100 which have been used, heretofore, in the installation of various fluid delivering assemblies and toilet assemblies in the past. The present fluid impervious gasket 10 is easy to install, does not absorb the fluid that might come into contact with it, can be rendered operable to cooperate with fluid waste conduits of varied outside and inside diametral dimensions, and further establishes a reliable water seal which is not likely to fail notwithstanding slight movements of the toilet during its subsequent use.

In compliance with the statute, the present invention 10 has been described in language more or less specific as to structural and methodical features. It is to be understood, however, that the invention is not limited to specific features shown and described since the means herein disclosed comprise preferred forms of putting the invention into effect. The invention is therefore claimed, in any of its forms or modifications, within the proper scope of the appended claims appropriately interpreted in accordance with the doctrine of equivalence.

I claim:

1. A synthetic, fluid impervious gasket for releasably, and fluid sealably, coupling a fluid delivering assembly and a fluid receiving assembly, comprising;

an annular-shaped main body fabricated from a synthetic, polymeric, closed-cell, resilient, fluid impervious material, and which further defines, at least in part, a medial fluid passageway which extends therethrough;

and wherein the annular-shaped main body has a first, substantially planar surface which releasably, and fluid sealably, mates with the fluid receiving assembly and the annular-shaped main body further has a second, concavely shaped surface which releasably, and fluid sealably, mates with the fluid delivering assembly;

and wherein the medial fluid passageway directs a source of fluid in a direction extending from the second, concavely shaped surface of the annular-shaped main body and in a direction toward the first, substantially planar surface;

a flexible funnel fabricated from the synthetic, polymeric, closed-cell, resilient, and fluid impervious material, and wherein the flexible funnel has a frustum shape, and wherein the flexible funnel is made integral with the annular-shaped main body, and wherein the flexible funnel defines, at least in part, the medial fluid passageway which extends therethrough, and wherein the flexible funnel can be selectively moved between a first position, and a second position, so as allow the annular-shaped main body to releasebly, and fluid sealably, engage with a fluid delivering assembly end fluid receiving assembly;

and wherein the medial fluid passageway is defined, at least part, by a longitudinal line of reference, and wherein the flexible funnel, when located in the first position, is at least in part, telescopingly positioned the annular-shaped main body, and is substantially coaxially aligned with the longitudinal line of reference;

and wherein the flexible funnel is defined, at least in part, by a first end which is coupled to the annular-shaped main body at a location near the first, substantially planar surface, and an opposite, distal, second end;

and wherein the flexible funnel, when located in the second position, depends outwardly relative to the first, substantially planar surface of the annular-shaped main body, and wherein the opposite, distal, second end of the flexible funnel is disposed in a fluid delivering relationship relative to the fluid receiving assembly; and when the flexible funnel is located in the first position, the medial fluid passageway directs the source of fluid in a direction extending from the opposite, distal, second end of the flexible funnel, and in a direction towards the first end thereof; and when the flexible funnel is located in the second position, the medial fluid passageway directs the source of fluid in a direction extending from the first end of the flexible funnel, and in a direction towards the opposite, distal, second end thereof.

2. A synthetic, fluid impervious gasket as claimed in claim 1, and wherein the fluid receiving assembly includes a toilet flange which is fluid sealably coupled to a waste, drain conduit.

3. A synthetic, fluid impervious gasket as claimed in claim 1, and wherein the medial fluid passageway has a predetermined diametral dimension which diminishes when measured in a direction extending from the second, concavely shaped surface of the annular-shaped main body, and in a direction towards the first, substantially planar surface.

4. A synthetic, fluid impervious gasket as claimed in claim 2, and wherein the toilet flange further includes at least one fastener which releasably and mateably engages the fluid delivery assembly, and further extends, at least in part, through the annular-shaped main body.

5. A synthetic, fluid impervious gasket as claimed in claim 4, and wherein the annular-shaped main body further defines a fastener receiving passageway which extends therethrough between the first, substantially planar surface, and the second, concavely shaped surface, and wherein the fastener extends through the fastener receiving passageway, and in a direction from the first, substantially planar surface, and towards the second, concavely shaped surface.

6. A synthetic, fluid impervious gasket as claimed in claim 5, and wherein the fluid delivery assembly includes a toilet base that has an outlet portion, and wherein the flexible funnel, when located in the first position, releasably, matingly, and fluid sealably, cooperates with the outlet portion.

7. A synthetic, fluid impervious gasket as claimed in claim 6, and wherein the second, concavely shaped surface of the annular-shaped body includes an inwardly facing portion which defines, at least in part, portion of the medial fluid passageway, and the outlet portion telescopingly extends, at least in part, within the inwardly facing portion of the annular-shaped main body, and is disposed in a fluid delivering relationship relative to the medial fluid passageway.

8. A synthetic, fluid impervious gasket as claimed in claim 7, and wherein the flexible funnel is defined, at least in part by opposite first and second outside facing surfaces, and wherein the flexible funnel, when located in the first position, orients the first outside facing surface in a fluid delivering relationship relative to the fluid receiving assembly, and wherein the flexible funnel, when located in the second position, orients the second outside facing surface in a fluid delivering relationship relative to the fluid receiving assembly.

9. A synthetic, fluid impervious gasket as claimed in claim 8, and wherein the synthetic, fluid impervious material uniformly repels a source of fluid despite a tearing or puncturing of the main body.

10. A synthetic, fluid impervious gasket as claimed in claim 9, and wherein the opposite, distal, second end of the flexible funnel defines a substantially planar surface.

11. A synthetic, fluid impervious gasket as claimed in claim 1, and wherein the second, concavely shaped surface is defined by a first, outwardly facing, and circumscribing wall, a floor region joined to the outwardly facing wall, and a second, inwardly positioned wall which is joined to the floor region, and which is further located in spaced relation relative to the outwardly facing wall, and wherein the second, inwardly positioned wall, defines, at least in part, the medial fluid passageway, and wherein the concavely shaped surface further includes a plurality of radially extending reinforcement walls which are attached to each of the floor region, and are further endwardly attached to, and extend between the respective first, outwardly facing surface, and the second, inwardly positioned wall, and wherein the respective radially extending reinforcement walls are spaced from each other, and further define discrete cavities therebetween, and wherein the respective reinforcement walls have a variable height dimension.

12. A synthetic, fluid impervious gasket for releasably, and fluid sealably, coupling together a fluid delivery assembly, and a fluid receiving assembly, comprising:

an annular-shaped main body fabricated from a synthetic, polymeric, closed-cell, resilient, and fluid impervious material, and which further defines, at least in part, a medial fluid passageway extending therethrough, and wherein the medial fluid passageway is defined, at least in part, by a longitudinal line of reference, and wherein the annular-shaped main body further has a first, substantially planar surface which releasably, and fluid sealably, mates with a fluid receiving assembly, and a second, concavely shaped surface which releasably, and fluid sealably, mates with a fluid delivering assembly; and a flexible funnel fabricated from the synthetic, polymeric, closed-cell, resilient, and fluid impervious material, and wherein the flexible funnel is frustum shaped, and further has a first end that is made integral with the annular-shaped main body at a location which is near the first, substantially planar surface, and is further oriented in substantially coaxial alignment with the longitudinal line of reference, and wherein the flexible funnel further defines, at least in part, a portion of the medial fluid passageway, and wherein the flexible funnel is positioned in a fluid delivering relationship relative to the fluid receiving assembly, and wherein the flexible funnel is selectively moveable between a first and a second operational position so as to allow the annular-shaped main body to fluid sealably, cooperate with the fluid receiving assembly, and wherein the flexible funnel when located in the first operational position is, at least in part, telescopingly positioned within the annular-shaped main body, and when located in the second operational position, depends outwardly relative to the first, substantially planar surface of the annular-shaped main body.

13. A synthetic, fluid impervious gasket as claimed in claim 12, and wherein the synthetic, polymeric, closed-cell, resilient, and fluid impervious material is fabricated from ethylene vinyl acetate, or an olefin block copolymer.

14. A synthetic, fluid impervious gasket as claimed in claim 1, and wherein the synthetic, polymeric, closed-cell, resilient, and fluid impervious material is fabricated from ethylene vinyl acetate, or an olefin block copolymer.

15. A synthetic, fluid impervious gasket as claimed in claim 1, and wherein the synthetic, polymeric, closed-cell, resilient, fluid impervious material has a uniform density which lies in a range of 1 pound to about 50 pounds per cubic foot.

* * * * *